United States Patent [19]

Lipsker

[11] Patent Number: 4,761,098

[45] Date of Patent: Aug. 2, 1988

[54] DRILLING MEANS SERVING AS GROUND ANCHOR AND METHOD

[76] Inventor: Itshaq Lipsker, 24 Trumpeldor St., Ramath Hasharon, Israel

[21] Appl. No.: 63,317

[22] Filed: Jun. 18, 1987

[30] Foreign Application Priority Data

Jun. 24, 1986 [IL] Israel ..... 79202

[51] Int. Cl.[4] ..... E02D 5/74

[52] U.S. Cl. ..... 405/262; 405/241; 405/239; 405/244

[58] Field of Search ..... 405/262, 243, 239, 237, 405/238, 244, 241, 242, 259, 258

[56] References Cited

U.S. PATENT DOCUMENTS

| | | | |
|---|---|---|---|
| 1,181,141 | 5/1916 | Johnson | 405/243 X |
| 1,224,925 | 5/1917 | Hindmarsh | 405/244 X |
| 1,413,503 | 4/1922 | Stevens | 405/244 |
| 3,507,124 | 4/1970 | Torzillo | 405/241 |
| 3,855,745 | 12/1974 | Patterson et al. | 405/244 X |
| 4,036,026 | 7/1977 | Asayama | 405/262 |
| 4,685,834 | 8/1987 | Jordan | 405/237 |

FOREIGN PATENT DOCUMENTS

| | | | |
|---|---|---|---|
| 0119823 | 9/1980 | Japan | 405/262 |

*Primary Examiner*—Dennis L. Taylor

*Attorney, Agent, or Firm*—Fleit, Jacobson, Cohn & Price

[57] ABSTRACT

A ground- or soil anchor is prepared and placed in the ground by drilling a bore hole at the chosen site by means of a drilling assembly which comprises an elongated tubular member which serves as drive shaft for the drill, which latter has tapering rear end and is designed to be pulled into the said tubular member, the leading end of which is split so that the parts thereof-on the drill being pulled into it-are spread apart and are eventually embedded in grout inserted into the bore hole.

3 Claims, 2 Drawing Sheets

DRILLING MEANS SERVING AS GROUND ANCHOR AND METHOD

FIELD AND BACKGROUND OF INVENTION

The present invention relates to soil or ground anchors and more particularly to means and a method to create and to place in situ a soil anchor. When eventually in place the anchor obtained by the new method and the means therefor is substantially identical with conventional soil or ground anchors and as such is well known to men of the art, thus a detailed description of the anchor being superfluous.

OBJECT OF THE INVENTION

It is the main object of the invention to provide means for drilling the hole into which the soil or ground anchor is to be inserted which eventually form themselves the operative parts of the anchor. Conventionally soil anchors are placed in a previously, separately prepared bore hole, which—as is known—is then cast out with concrete grout or chemical substances. The new method and the new means dispense with separately drilling the bore hole and subsequently placing the soil or ground anchor in it. Contrarily to known practice the drilling means—at a certain stage of the drilling operation—are transformed into operative parts of the soil or ground anchor. It is obvious to those skilled in the art that the new method thus constitutes a considerable economic advantage over the conventional method.

SHORT SUMMARY OF INVENTION

The new means, according to the invention, comprise a drilling tool which is attached to a tension rod, the said rod extending to the surface and being located within an elongated tubular member which has an exterior, continuous helical ridge and which also serves to rotate the drilling tool, the said drilling tool being a body the rear portion of which, i.e. that which is connected to the said tension rod is tapering towards the connection with the rod, the leading end of the said tubular member being screw- or otherwise connected with the main part thereof, said leading end portion being split into at least two parts, such that on pull being exerted on the said tension rod, the said tapering portion of the drilling tool forces the parts of the said split end apart.

The new method comprises the steps of:

(a) drilling a bore hole by the assembly of the said drilling means during which soil is conveyed from the hole by being lifted on the said helical ridge, (b) continuing the drilling operation until a predetermined depth is reached, (c) exerting pull on the said tension rod and thereby causing the split end of the tubular member to be spread apart, (d) casting concrete grout or other conventional material into the bore hole and embedding the split apart parts of the end of the tubular member therein, (e) disconnecting the main part of the tubular member from the split end and recovering the former from the bore hole while injecting grout simultaneously, (f) securing the surface and of the tension rod in a conventional way.

SHORT DESCRIPTION OF DRAWINGS

The new means are shown schematically in sectional view in the accompanying drawings, wherein FIGS. 1–5 illustrate different stages of a bore hole and soil-anchor according to the invention.

DETAILED DESCRIPTION OF PREFERRED EMBODIMENT

Figure 1:
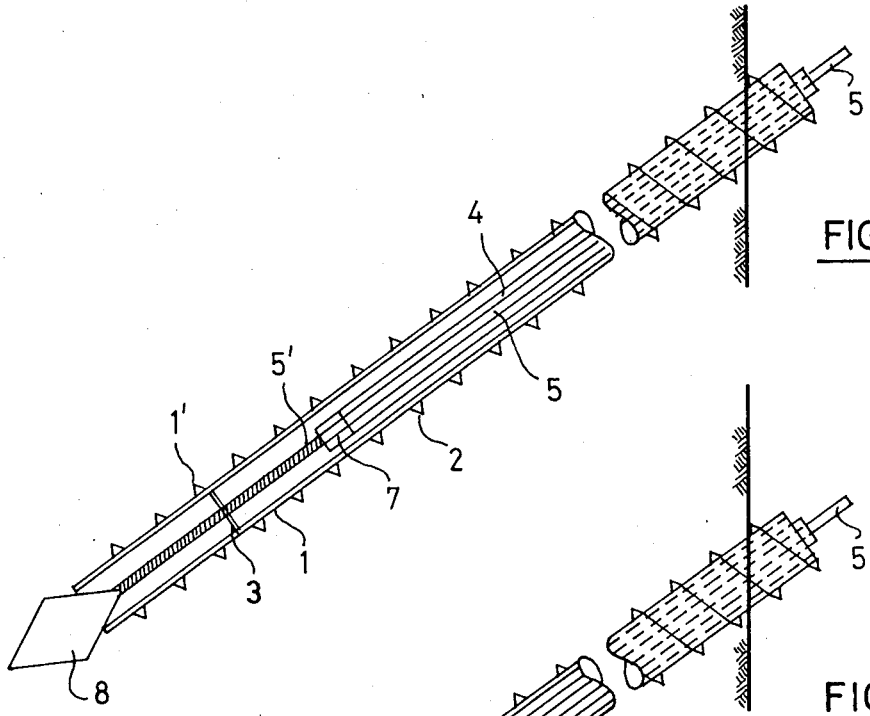

Turning to FIGS. 1–5—the new device is shown to comprise a tubular member 1 which has an exterior, continuous helix 2 the lowermost end 1' of member 1 being connected at 3 with the main part of member 1. Within member 1 extends an enveloping pipe 4 and in the latter a pull rod 5 which can be operated by means of a jack or wrench indicated schematically at 6.

The lowermost portion 1' of member 1—which, as has been stated, is detachable from the main part is lengthwise split into two halves. The lowermost section of the pull rod 5 is screw connected at 7 to the main part of the rod. At the far end of rod 5 and fixed to it is provided a drilling tool 8 the rear end of which is tapering, as seen in the drawings.

Figure 2:
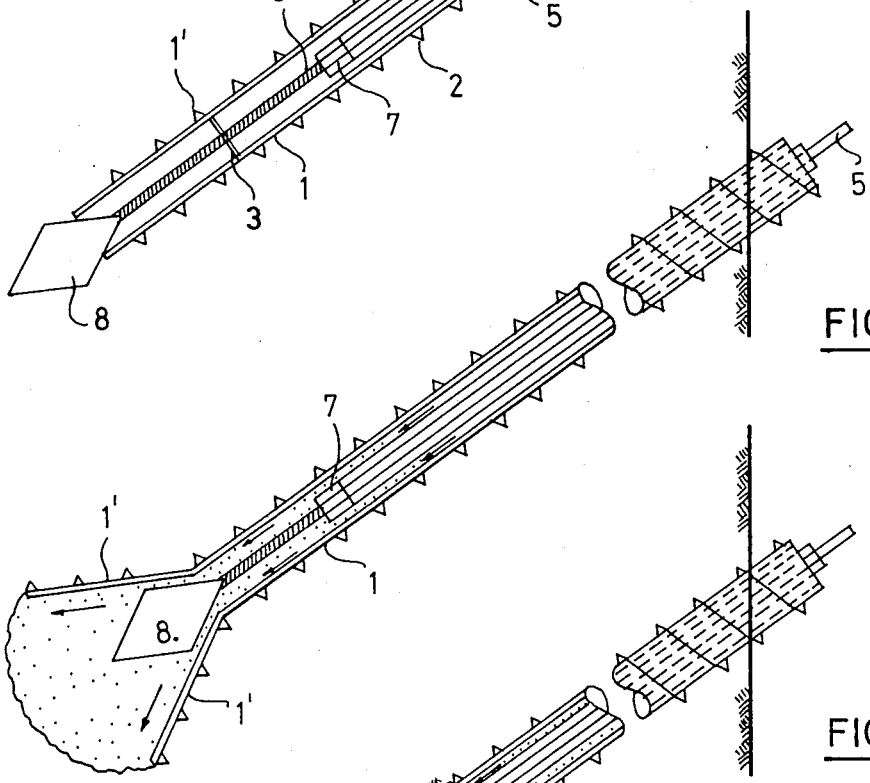
Figure 3:
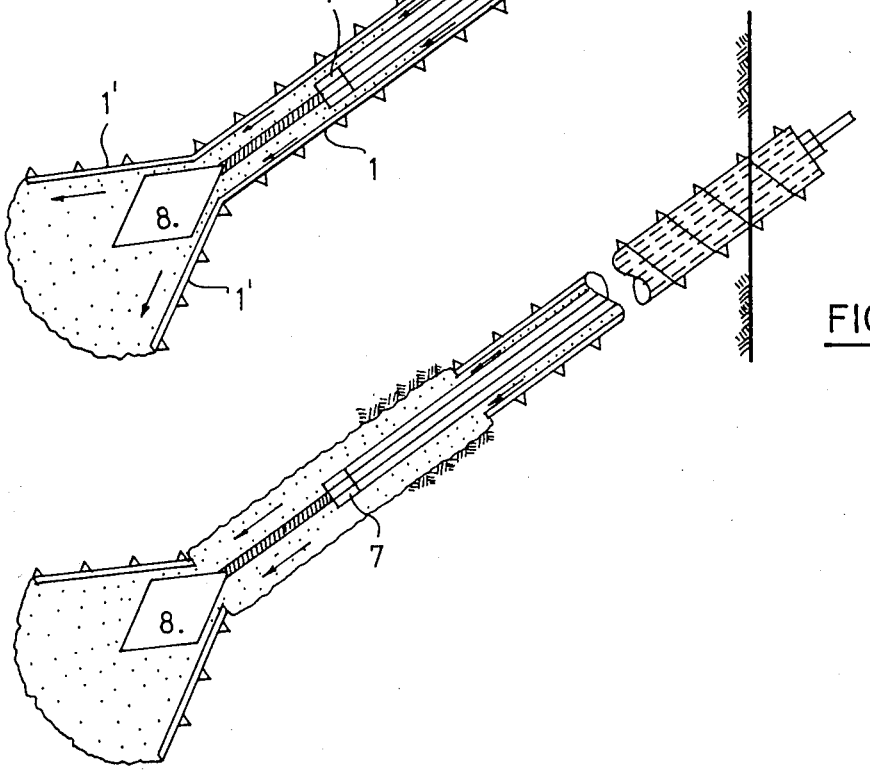
Figures 4, 5:
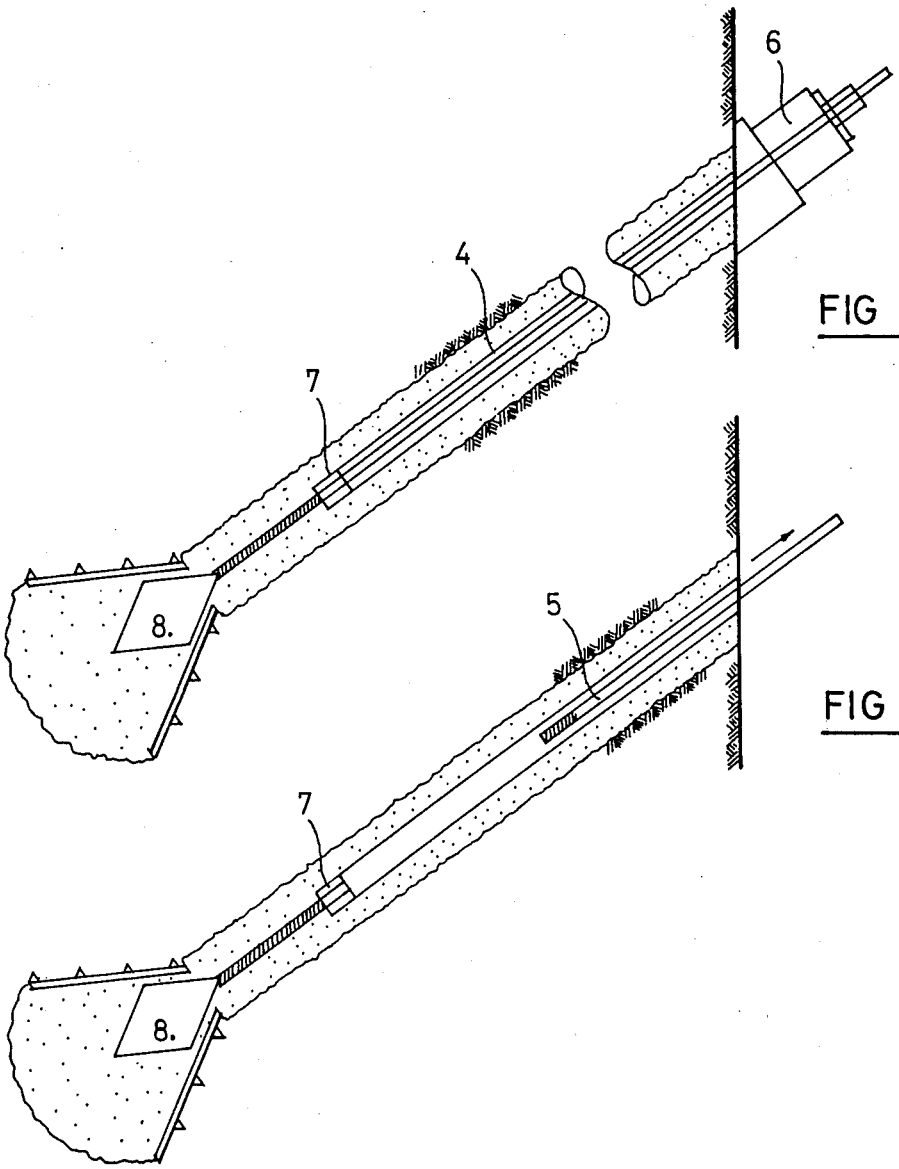

The new device is actuated as follows:

The device is placed at the predetermined angle with the tool 8 facing the ground. Now the device is actuated imparting rotation (by conventional means, not shown) until the desired, predetermined depth of a bore hole is reached, possibly adding one or more additional tubular members with the exterior helix as well as tension rods. While this drilling operation goes on excavated soil is lifted to the surface on the helix 2. Once the desired depth of bore hole has reached, the drill 8 is pulled up by means of rod 5 thereby causing the rear end of the tool to spread apart the two halves of portion 1', thereby creating a cavity as shown in FIGS. 2 and 3.

The said space is simultaneously filled with concrete grout or any other mass commonly used for such purposes, part of the grout or mass escaping from the space between the halves 1' and settling around the latter. The filling in of grout or other mass occurs along the enveloping pipe 4 as indicated by arrows in FIGS. 1–2.

After spreading apart the parts of portion 1' and inserting grout the member 1 is disconnected from its portion 1' and is pulled out while grouting may continue.

Finally the required tension is applied to rod 5 and it is secured at the surface in a conventional way.

It is possible, when the anchor has been inserted for a limited period of time, to unscrew the main portion of the pull rod and retrieve it for further use.

Where the anchor is to be placed in rock or firm soil where no cave in may be expected, it might be necessary to first drill the bore hole and then insert the device described above. In that case the drill used is no part of the device and only a tapering or conical member is required to spread apart the lowermost portion of the tubular member.

Incidentally, while the use of the new device has been shown in connection with ground anchors, obliquely entering the ground, it is within the gist of the invention to drill vertically, e.g. where piles have to be prepared.

It would be within the scope and gist of the invention to use whatever drilling tool of known type, provided that its rear end is tapering and is thus adapted to force apart the parts of the split portion of the tubular member. The helical ridge on the latter serves to convey soil to the top; where sufficient supply of water is available the elongated tubular member need not be provided with the exterior helix; the soil may be flushed out by flow of water and conveyed to the top by the flow.

What is claimed is:

1. An assembly of drilling means which at the same time serve as ground- or soil anchor comprising a drilling tool which is attached to a tension rod, the said rod extending to the surface and being located within an elongated tubular member which has an exterior, continuous helical ridge which also serves to rotate the drilling tool, the said drilling tool being a body the rear portion of which, i.e. that which is connected to the said tension rod is tapering towards the connection with the rod, the leading end of the said tubular member being screw- or otherwise connected with the main part thereof, said leading end portion being split into at least two parts, such that on pull being exerted on the said tension rod, the said tapering portion of the drilling tool forces the parts of the said split end apart.

2. A method of creating a ground- or soil anchor and inserting it into the ground, comprising the steps of:

(a) drilling a bore hole by the assembly of claim 1 during which soil is conveyed from the hole by being lifted on the said helical ridge, (b) continuing the drilling operation until a predetermined depth is reached, (c) exerting pull on the said tension rod and thereby causing the split end of the tubular member to be spread apart, (d) casting concrete grout or other conventional material into the bore hole and embedding the split apart parts of the end of the tubular member therein, (e) disconnecting the main part of the tubular member from the split end and recovering the former from the bore hole while injecting grout simultaneously, (f) securing the surface and of the tension rod in a conventional way.

3. The method of claim 2 wherein the soil is conveyed to the top of the bore hole by a stream of flushing water.

* * * * *